United States Patent [19]

Messick et al.

[11] Patent Number: 4,491,003

[45] Date of Patent: Jan. 1, 1985

[54] FABRICATION OF HELICALLY-WOUND SPIRALS FOR METAL WIRE BELTS

[75] Inventors: George H. Messick; John C. Adkins, both of Cambridge, Md.

[73] Assignee: Maryland Wire Belts, Inc., Church Creek, Md.

[21] Appl. No.: 276,697

[22] Filed: Jun. 23, 1981

[51] Int. Cl.[3] ..... B21F 35/02

[52] U.S. Cl. ..... 72/137; 140/92.2

[58] Field of Search ..... 140/92.3, 92.4, 92.7; 72/137, 142, 143, 144, 183; 57/311

[56] References Cited

U.S. PATENT DOCUMENTS

| | | | |
|---|---|---|---|
| 352,909 | 11/1886 | Billings . | |
| 2,476,180 | 7/1949 | Charles | 57/311 |
| 2,625,961 | 1/1953 | Bergandi | 140/92.94 |
| 3,008,497 | 11/1961 | Bergandi | 140/92.4 |
| 3,308,856 | 3/1964 | Ploss | 140/71 R |
| 3,512,760 | 4/1970 | Rohrbacher | 256/32 |
| 3,525,096 | 8/1970 | Klenz | 72/206 |
| 4,044,583 | 8/1977 | Kinney, Jr. | 140/92.4 |

*Primary Examiner*—Francis S. Husar
*Assistant Examiner*—Linda McLaughlin
*Attorney, Agent, or Firm*—Raymond N. Baker

[57] ABSTRACT

Methods and apparatus are disclosed for continuous-line fabrication of helically wound spirals of desired cross-sectional configuration, such as planar surface spirals, for assembly into conveyor belts. In-line wire shaping and handling procedures and apparatus enable consistently reliable production of uniformly shaped spirals at commercial production rates. Round wire from unsupported coils is shaped in line and controlled as directed to a winding mandrel. Orientation of the shaped wire about its central longitudinal axis, winding tension control, presetting a longitudinal camber in the shaped wire, and wire shaping control are used to compensate for changes in mechanical characteristics of the wire or wire diameter, which occur along the length of a coil, without affecting established winding machine parameters such as lead-in angle for the wire or longitudinal location along the mandrel for starting helical winding.

21 Claims, 14 Drawing Figures

FABRICATION OF HELICALLY-WOUND SPIRALS FOR METAL WIRE BELTS

This invention is concerned with continuous-line methods and apparatus for shaping round wire and preorienting the shaped wire for helical winding so as to consistently produce elongated spirals presenting shaped surfaces and desired cross-sectional configuration uniformly throughout their lengths.

Conveyor belts have generally been assembled from helically-wound spirals fabricated from round wire (American National Standard "Metal Belts" ANSI-13, published by Metal Belt Institute, Copyright 1975). A typical prior art practice for winding spirals is described in the U.S. patent to Ploss U.S. Pat. No. 3,308,856. In such practice, spirals are formed on a mandrel mounted within a cylindrical guide tool which defines a helical path for the wire. Driving the mandrel pulls the wire onto the mandrel through such guide tooling establishing a helical angle relationship between the wire and the axis of rotation of the mandrel. That such round wire turned about its longitudinal axis due to winding at the helical angle to the longitudinal axis of rotation of the mandrel was not considered for surface configuration purposes since the surface presented by the round wire was not affected by such axial turning of the wire.

Helical winding of shaped wire to form spirals is not new in the metal wire fabric art. For example, winding of flat wire to produce woven wire chain-link fence is disclosed in the U.S. patent to Rohrbacher U.S. Pat. No. 3,512,760. As stated in that patent, "Forming coils from wires having flat faces inherently produces looped reverse bends having noncomplimentary confronting surfaces".

More recently, however, an interest was developed in connector-rod assembly of conveyor belts from flat wire. The objective has been to produce a flat work surface for conveying articles. In working on development of a flat surface conveyor belt, flattened wire was specially wound on spools for processing rather than being fed into winding machinery from unsupported coils as round wire is conventionally and more economically supplied for fabricating metal wire spirals for assembly into conveyor belts.

However, spirals with the desired planar surface characteristics were not obtainable notwithstanding use of special spool winding of the flat wire. Among other problems, the helical winding itself distorted the cross-sectional configuration of individual loops in a spiral and the loop surfaces being formed when fabricating spirals from flattened wire. Empirical measures for fabricating the spirals from flat wire were employed in order to supply conveyor belts which could be referred to as flat surface belts. But adjustments required for changes in wire characteristics would require changes in previously established parameters such as the lead-in angle to the mandrel or the location on the twisted portion of the mandrel first encountered by the wire. The winding rate times and other requirements in attempting to make planar surface spirals with desired uniformity in cross-sectional height for assembly into belts were such that no commercially acceptable and consistently dependable production method was available.

The combination of the present invention enables adjustments to be made for variables, such as changes in the wire characteristics, without disturbing parameters such as the lead-in angle and the longitudinal starting point along the mandrel which have been established on the helical winding machine. Commercially reliable production methods and apparatus are provided for consistently producing helically-wound spirals of desired uniformity in cross-sectional configuration and free of fractional turns or canting of the wire in individual loops along the length of the spirals.

The invention provides for fabrication of spirals in which the elongated leg portion of each loop is disposed the same as the corresponding leg portions are disposed in other loops so as to provide a desired working surface in an assembled conveyor belt. For example, in shaping the wire to have diametrically opposed flat surfaces, the invention provides for consistent production of spirals of desired uniformity in cross-sectional height with individual spirals presenting a flat linearly-extended external loop surface lying in substantially the same plane as corresponding surfaces of other loops in the spiral.

The invention also provides economies through use of conventional unsupported coils of round wire and provides for in-line shaping of round wire in a manner which contributes to the desired control of loop formation and spiral fabrication.

Other advantages and contributions of the invention are considered in the more detailed description of the invention associated with the accompanying drawings. In these drawings.

Figure 1:
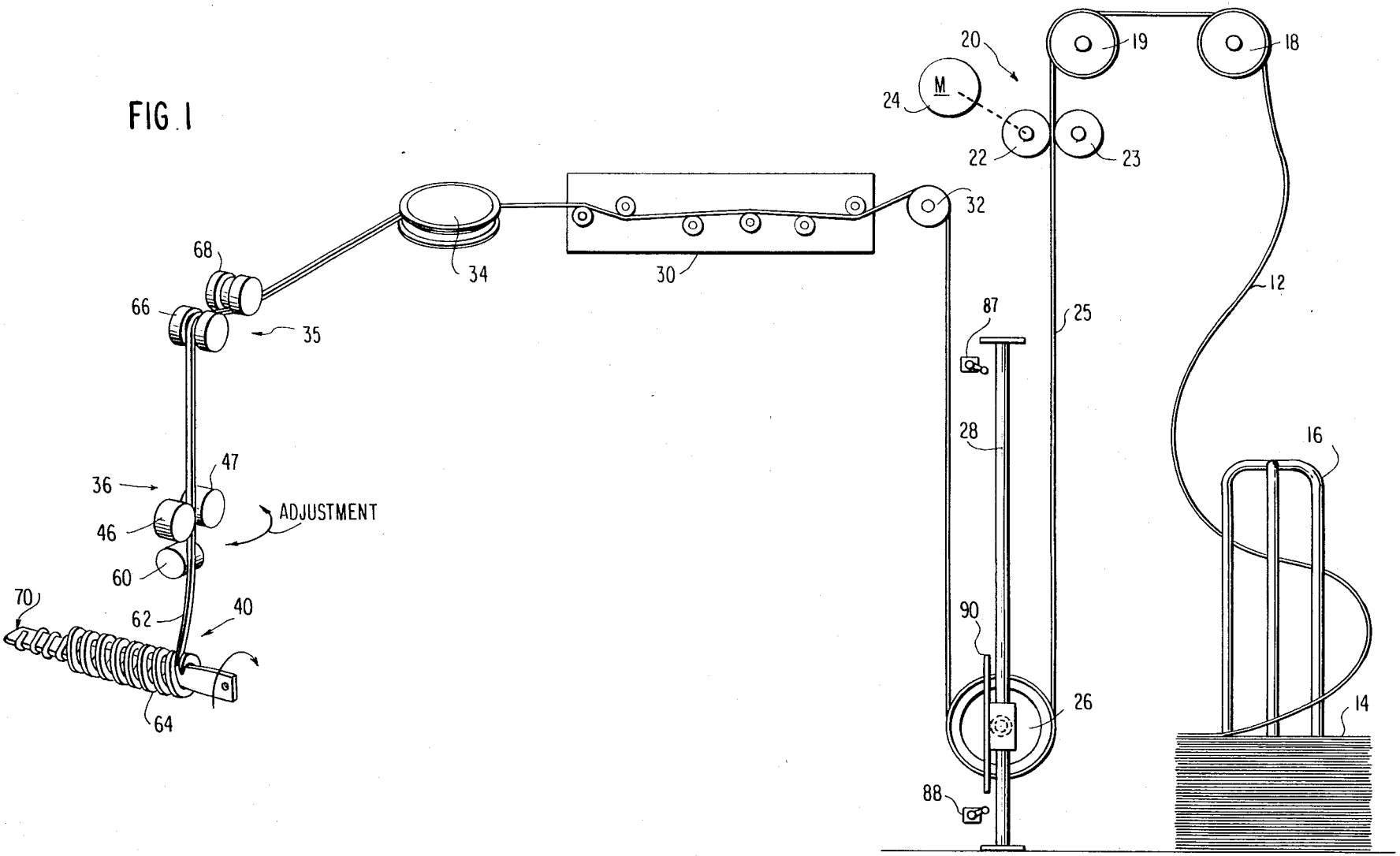
FIG. 1 is a schematic general arrangement view, partially in perspective, of continuous-line apparatus for carrying out the present invention.

Referring to FIG. 1, continuous length round wire 12 is supplied from spool-free (unsupported) round wire coils 14 disposed on rack 16. The wire is directed over guide rolls 18, 19 to wire shaping means 20 which, as shown, includes flattening rolls 22, 23 driven by motor 24. Both flattening rolls of the shaping means can be driven from motor 24 and act to withdraw round wire from supply 14. In a preferred embodiment, two diametrically opposed surfaces of the round wire 12 are flattened by passage through the driven wire shaping means 20 so that the shaped wire presents two diametrically opposed planar surfaces. Other non-circular cross-sectional shapes, such as a four planar surface, substantially rectangular cross section, wire can be provided.

Figure 3:
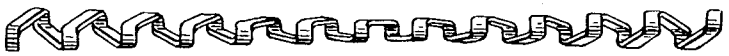
FIG. 3 is a side view of an elongated helically-wound spiral for depicting wire turning problems likely to occur with shaped wire which are eliminated by in-line wire control exercised as part of the invention.

Shaping the wire as part of a continuous in-line process contributes economic advantages over buying preflattened wire or preflattening the wire, both of which require special spool winding. In-line shaping of the round wire as part of the continuous spiral fabrication process also reduces the opportunity for undesirable turns in the wire which can distort the loops being formed; that is, better control is obtained and maintained helping to avoid the wire turning problems as depicted by FIG. 3. The in-line shaping of round wire can also be used to provide desired wire tension control for winding. Further, shaping the plain carbon steel wire and stainless steel wire from which most metal wire belts are produced assures a basic work hardness and the control of shaping facilitates utilization of the teachings of the present invention.

As part of the wire control procedure of the embodiment of FIG. 1, continuous-length shaped wire 25 is directed to a tower reservoir which includes a weighted roll 26 which moves vertically along upright stanchion 28 in response to wire requirements. Roll 26 is weighted sufficiently to provide desired wire control to prevent twisting of the wire after shaping. In the embodiment of FIG. 1, wire tension control for helical winding is provided independently of wire shaping. A conventional tension box 30 is used to control the tension in the wire after its passage around guide roll 32. The shaped wire 25, under controlled tension after exit from tension box 30, is directed toward the helically winding apparatus around guide roll 34.

While not shown, for purposes of simplifying the illustration, it will be readily apparent to those skilled in this art that dual supplies of wire, shaping apparatus, control apparatus, and winding apparatus can be provided on the same machine for winding both left-hand and right-hand spirals simultaneously for assembly into a balanced weave belt. Such dual winding practice is, in itself, conventional, but features of the present invention facilitate adjustments as required for the winding of both right or left-hand spirals, and provide for interrelated adjustments to maintain a desired uniformity in cross-sectional configuration of both right and left-hand spirals which provide desired advantages in the use of an assembled belt as a conveying means.

Referring to FIG. 1, at station 35, a longitudinal camber is preset in the shaped wire and, at station 36, a controlled turning of the shaped wire about its longitudinal axis presets the shaped surface axially. Such orientation of the shaped wire 25 takes place as the wire makes its final approach to helically winding apparatus 40.

In accordance with the invention, the shaped wire is preoriented about its centerline so that adjustments as required do not change the mandrel lead-in angle nor the initial contact point of the wire along the length of the mandrel so that the uniform production problems of the prior art are substantially eliminated.

Figure 2:
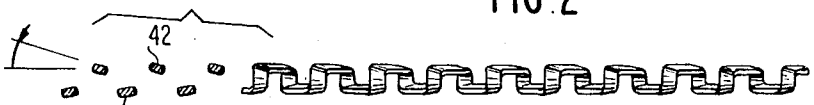
FIG. 2 is a side view, partially in longitudinal cross-section, of an elongated helically-wound spiral for depicting a surface canting problem encountered in spiral winding of shaped wire.

To illustrate more clearly the canting problem which occurs when winding flattened wire, portions of the spiral are shown in longitudinal cross section in FIG. 2. Surfaces 42 and 43 for example are, respectively, top and bottom external cross-sectional surfaces of individual loops of a spiral which become angularly canted with respect to the longitudinal winding axis. Such canting results from winding of shaped wire at an angle to the longitudinal axis of rotation of the mandrel to form a spiral. This canting problem existed along the extended-length leg portion of a loop in a spiral. When assembled with other spirals, these extended-length leg portions comprise the work-contact conveying surface of a belt. Due to such surface canting problems, items carried by a conveyor belt experienced point contacts, or contact along a thin line, with canted edges of such loop surfaces of the belt similar to the type of support contact experienced with round wire conveyor belts. As a result, a desired objective for flat shaped wire belts, that is extended surface area contact, was not being obtained.

In accordance with one aspect of the invention, the shaped wire is controllably turned about its centerline longitudinal axis in a direction opposite to the direction of canting induced by helically winding a wire at an angle to the longitudinal drive axis of a mandrel. Further, adjustments in axial orientation and longitudinal camber are available in a manner which does not disturb helical winding parameters established on the machine such as lead-in angle for the wire or the starting point longitudinally along the mandrel so that desired uniformity in cross-sectional configuration of spirals can be readily maintained notwithstanding changes in characteristics of the wire being wound thus avoiding problems such as those shown in FIG. 3.

Figure 7:
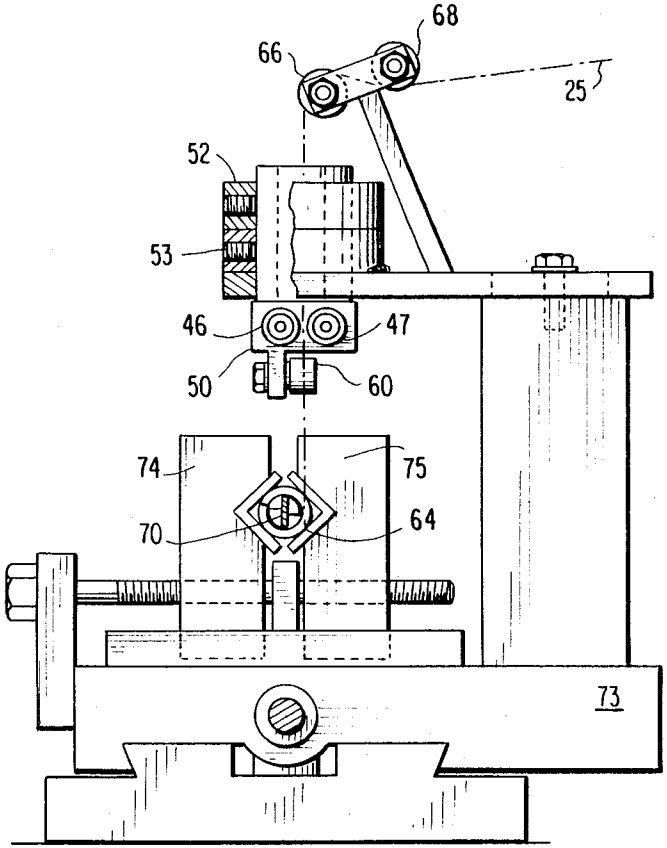
FIG. 7 is a side view, partially in cross section, taken along the line 7—7 of FIG. 6.
Figure 6:
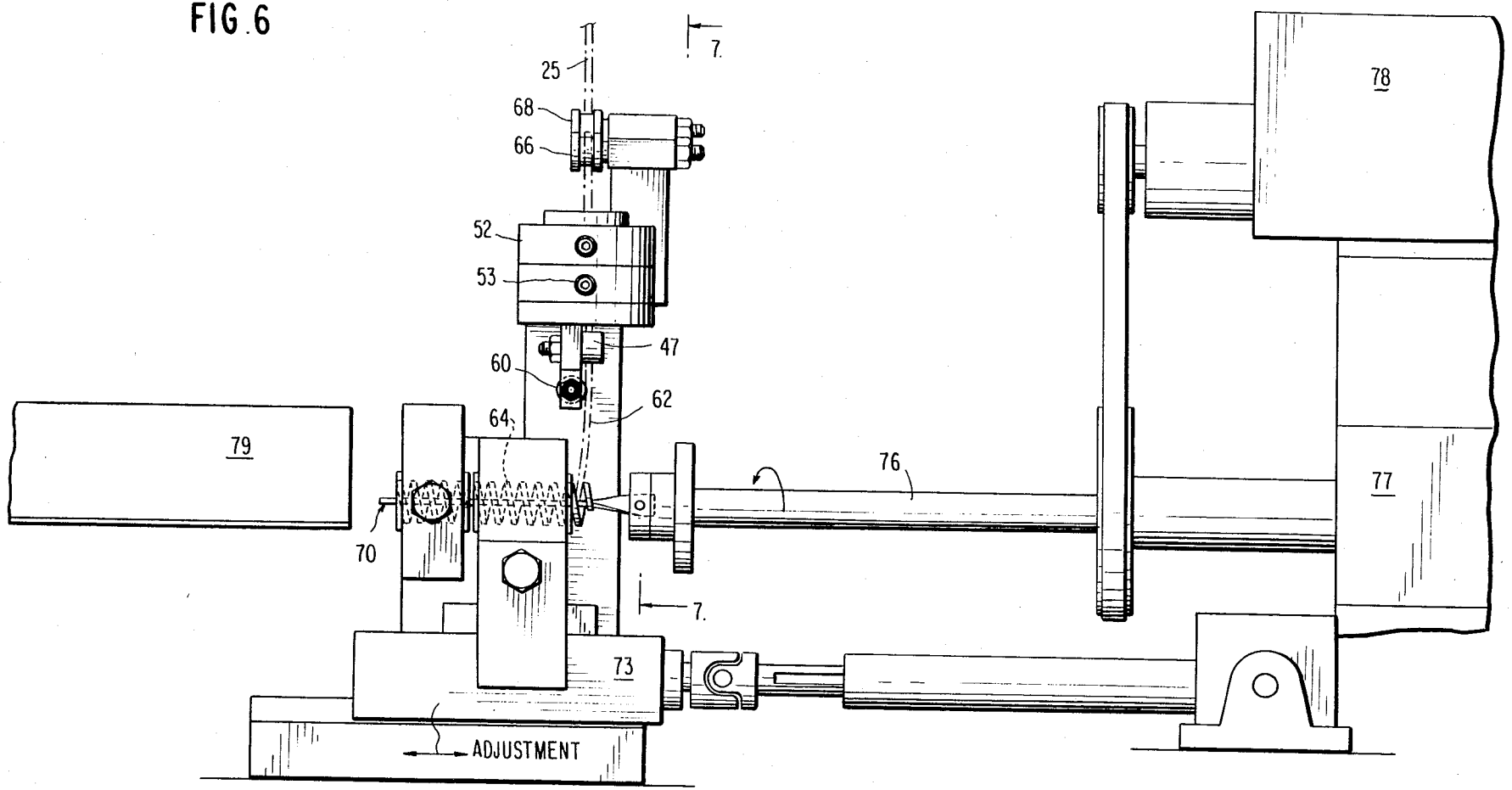
FIG. 6 is a frontal view, partially in cross section, of apparatus embodying the invention.

The axial turning of the shaped wire about its longitudinal axis for purposes of presetting the shaped surface of the wire for winding is carried out at station 36 by rolls 46 and 47. The axial orientation means is shown in greater detail in FIG. 7 and the same reference numerals are used in the various figures to designate the same parts. The wire passes between, and is grasped by, rolls 46 and 47 which contact the flattened surfaces on diametrically opposed sides of the wire. Station 36, in effect, presents an aperture of a cross-sectional configuration which provides establishment of desired axial orientation for the shaped surface(s) by passage through the aperture. The bight between rolls 46 and 47 of FIGS. 1, 6, and 7 provides such control for flattened wire. The aperture controls axial turning of the wire to establish an angular predisposition of the shaped surface(s) for approach to the winding mandrel. Adjustments in this centerline axial orientation means, as may be required by changing wire characteristics, are carried out without disturbing previously established machine parameters.

In the specific embodiment illustrated, the angular position of the bight between rolls 46 and 47 is adjustable about the centerline axis of the wire through the tooling shown in FIGS. 6 and 7. Referring to FIG. 7, rolls 46 and 47 are mounted on plate 50 which extends internally, as shown in dotted lines, of locking structure disposed along the path of the wire. Rotation of plate 50 about the vertical axis is controlled by rotating element 52 when set screw 53 is loosened. Plate 50 is rotated about the vertical axis (the centerline axis of the wire) and then locked in the desired angular position by set screw 53. Since shaped wire 25 is grasped by rolls 46 and 47 which contact the flat surfaces of the shaped wire, rotating plate 50 will impose, and preset to an extent determined by hardness characteristics of the wire, an angular turn about the centerline longitudinal axis of the shaped wire.

The amount of axial turning applied to the shaped wire is selected to preset an axial angular disposition for the shaped wire which is equal and opposite to the canting introduced by subsequent helical winding. After such axial orientation, the shaped wire is then directed into the winding station 40 along a path approximating that established by helical guide tooling. The lead-in angle of the wire is not disturbed by the centerline axial adjustment taught.

The shaped wire is preset axially to offset the cant introduced during subsequent helical winding so that each loop of the spiral produced will present its shaped surface in the same manner. When the wire is shaped by flattening on two diametrically opposed surfaces, corresponding linearly-extended leg surfaces, both externally and internally of each loop of a spiral, will lie in the same plane.

After passage between rolls 46 and 47, the wire is guided by roll 60 (FIGS. 1 and 7) toward the helical winding apparatus 40. As shown in FIGS. 1 and 6, the angle for shaped wire 25 at location 62 in passing from roll 60 to the helically winding apparatus is approximately equal to the helical winding angle so that the shaped wire 25 is fed into the guide worm tool 64 at approximately the same angle as the helical angle established by that tool. Roll 60 is mounted on the support block 50 below the axially orienting aperture established by rolls 46 and 47 so that the shaped wire, upon exit from those rolls, contacts guide roll 60. The desired longitudinal direction of movement established for approach to the helical winding station 40 is not disturbed by axial rotation of such aperture since roll 60 rotates about the centerline axis with angular adjustment of the aperture formed between rolls 46, 47.

In addition to the axial orientation established in the shaped wire, a longitudinal camber can be preset at station 35. This longitudinal camber is established in the wire shortly prior to and as the shaped wire is directed through station 36 so that adjustment does not interfere with preestablished parameters set up on the machine. Contact with roll means 66 (FIGS. 1, 6 and 7) causes the shaped wire to pass through a small radius establishing a longitudinal camber in the wire which is concave on the roll contact side and convex on the diametrically opposite side. Roll 68 helps to guide and establish desired angle for the wire passing around roll 66. The desired change in direction of movement about roll 66 establishes longitudinal camber by stressing convex surface fibers beyond their elastic limit. The effects of longitudinal camber are established in the shaped wire although not exemplified until the control tension on the wire for winding is relieved through wrapping of the wire about the mandrel. Longitudinal camber can be introduced by other means such as a change in direction about a rod.

Figure 5:
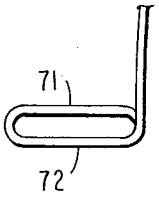
FIG. 5 is an end view during helical winding of a spiral for depicting a linear configuration in the extended-length leg portions of a spiral loop.
Figure 4:
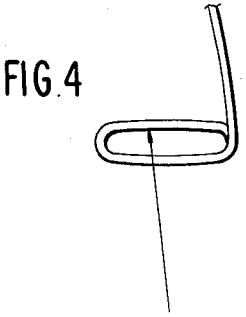
FIG. 4 is an end view during helical winding of a spiral for depicting a curvilinear configuration in the extended-length leg portions of a spiral loop.

As is known, longitudinal camber can be used to effect the cross-sectional shape of a spiral loop obtained during winding about a non-circular mandrel such as 70. An elliptical (curvilinear with the arrow shown in FIG. 4 to indicate an extended length radius) cross-sectional configuration can be obtained as shown in FIG. 4 by confronting mandrel 70 with the concave surface of the longitudinal camber. A linear configuration, presenting linear surfaces 71, 72 as shown in FIG. 5, can be readily obtained during winding by confronting the mandrel with the convex surface of the preset longitudinal camber. Adjustment in axial orientation and the effects of longitudinal cambers are utilized to provide spirals of desired uniformity in cross-sectional height.

The axial turning and longitudinal camber imposed on the shaped wire can be adjusted independently of and without disturbing location of the guide tooling 64 along the length dimension of mandrel 70 or the lead-in angle. As shown in FIGS. 6 and 7, location of guide tooling 64 is determined by positional adjustment of base 73 which supports vise means 74, 75. The longitudinal position of mandrel 70 is fixed, being driven through shaft 76 by mandrel drive motor 77. Movement of base 73 in the longitudinal direction in relation to elongated mandrel 70 determines the longitudinal location of the guide tooling 64 for initiation of winding at the twisted portion of the mandrel for purposes known in the art and described later in relation to FIG. 8.

With the location of guide tooling 64 establishing the starting point on the mandrel 70 established by base 73, any adjustment in wire orientation required due to changing wire characteristics can be carried out at stations 35 and 36 without disturbing such established winding relationships.

In FIG. 6, counter 78 measures and records the number of turns and can be used to produce spirals of predetermined length. Guide tool 64 largely determines the pitch of the spiral being formed but a fine adjustment of the pitch can be carried out in a second tool on the straight portion of the mandrel, as in conventional winding practice, without disturbing the functions accomplished at stations 35 and 36. The spirals as produced are delivered from the free end of mandrel 70 into trough 79.

While a single winding apparatus has been illustrated and described, the present teachings are advantageously applied to dual winding apparatus conventionally set up on the same machine. Separate mandrels are provided for winding left-hand and right-hand spirals simultaneously so that such spirals are produced in side-by-side relationship for direct assembly with connector rods into a "balanced weave" belt. Since the great majority of conveyor belts, perhaps in excess of 80%, use some balanced weave pattern to facilitate proper tracking during usage, it is important to provide commercially acceptable production rates for balanced weave belts. Applying the adjustable features of the present invention discussed above to simultaneous fabrication of left and right-hand spirals enables consistent production of such spirals within acceptable tolerances of each other to provide good tracking qualities and at commercially acceptable rates for production of balanced weave belts.

The adjustment features of the present invention provide for maintaining any differential in cross-sectional heights of left and right-hand spirals within an acceptable tolerance limit and at a lower level than was previously attainable commercially. As is known, the mechanical properties of wire can change within a coil due to differences in annealing conditions within the coil or the diameter can vary along the length of a coil within gage tolerances. Such changes in the wire can distort the cross-sectional configuration and dimension of loops in a spiral. Canting of a shaped wire, which manifests itself both internally and externally of a loop, can cause in excess of 0.015" difference in cross-sectional height of a loop when working with twelve (12) gage wire.

Figure 14:
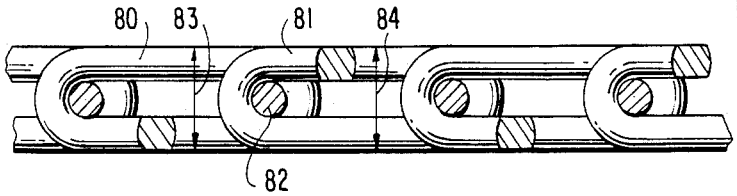
FIG. 14 is a cross-sectional view of a portion of a balanced weave conveyor belt for showing dimensional aspects provided by the present invention.

In fabricating spirals for balanced weave belts, any differential in cross-sectional heights of left and right-hand spirals should be kept within certain tolerances in order to provide proper tracking and for surface contact purposes. In a balanced weave belt, a right-hand spiral is connected to a left-hand spiral, and so forth, throughout the length of the belt. As shown in FIG. 14, spiral 80 is connected to spiral 81 by connector rod 82. The cross-sectional heights 83, 84 of such next adjacent spirals should be within accepted tolerances. If, for example, the right-hand spirals from one coil of wire are consistently larger in cross-sectional height than left-hand spirals being fabricated from another coil of wire, this will bias movement of the belt over support rolls and will diminish the planar surface contact area for support of conveyed articles by one-half.

The adjustments made available as part of the present invention provide for ease of maintenance within acceptable tolerances. As spirals are being formed, both right and left-hand spirals are checked for cross-sectional height with calipers. A change in wire characteristics in either wire can be readily compensated for with the present invention to maintain uniformity of spiral cross-sectional configuration while maintaining commercially acceptable production rates. A change in wire cant due to change in wire characteristics can be adjusted through plate 50. A change in cross-sectional height due to change in wire characteristics can be adjusted through the effect of tension control on longitudinal camber or change in the longitudinal camber itself. With the present invention, a cross-sectional height differential between right and left-hand spirals of no more than 0.002" to .003" can be readily maintained with twelve (12) gage wire; so that a differential of 0.005" is a practicable objective well within acceptable tolerance levels for balanced weave belts.

Figure 8:
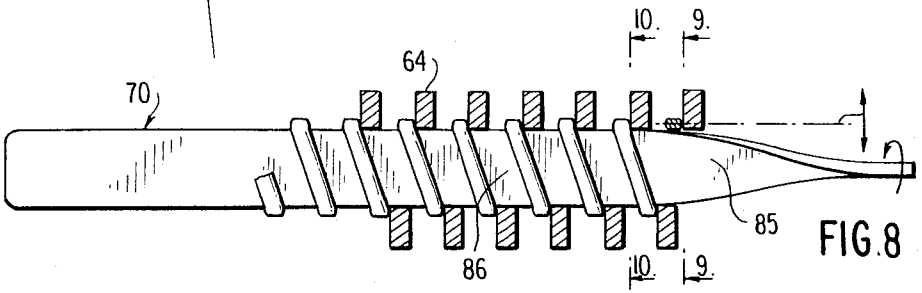
FIG. 8 is an enlarged view, partially in cross section, of a winding mandrel, guide tooling, and a portion of a spiral, for purposes of describing the present invention and its background.
Figure 10:
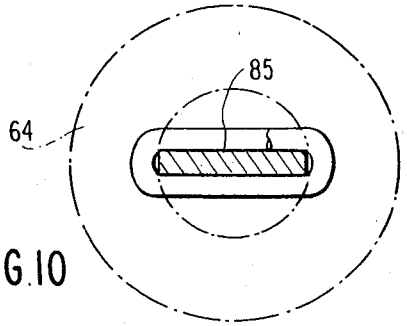
FIG. 10 is a cross-sectional view, partially in phantom lines, taken along the line 10—10 of FIG. 8.
Figure 9:
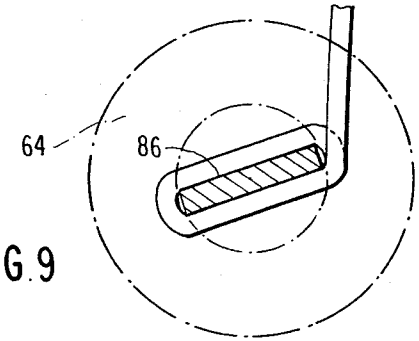
FIG. 9 is a cross-sectional view, partially in phantom lines, taken along the line 9—9 of FIG. 8.

As seen in FIG. 8, the shaped wire is fed onto the mandrel and guided in contact with one surface of the guide tooling 64 so as to avoid hunting in the guide-tooling opening. The helically wound wire is wound at the angled (also referred to as twisted) portion 85 of the mandrel 70. The location longitudinally of the mandrel is determined by spring-back characteristics of the wire determined in large part by annealing conditions applied to the wire by the manufacturer. This spring-back phenomenon and selection of location for starting winding at the angled portion of the mandrel are well known to those skilled in the art. As shown in FIG. 9, formation at the angled portion 85 of the mandrel 70 results in a spring-back at the straight portion 86 of the mandrel shown by FIG. 10 as the wire moves onto such portion of mandrel 70 so that the spiral formed can be flat upon exit from the mandrel.

Referring to FIG. 1, drive motor 24 is controlled by ON switch 87 and OFF switch 88 when contacted by bar 90 as dance roll 26 moves up and down stanchion 28. When the reservoir of shaped metal is filled, bar 90 contacts OFF switch 88 turning off motor 24. When the reservoir is near depletion and dance roll 26 nears the top of its movement, bar 90 contacts ON switch 86 which activates motor 24 to rotate the flattening rolls 22, 23 and supply additional shaped wire. Shaping of the wire is independent of winding tension control in the embodiment of FIG. 1.

Figure 11:
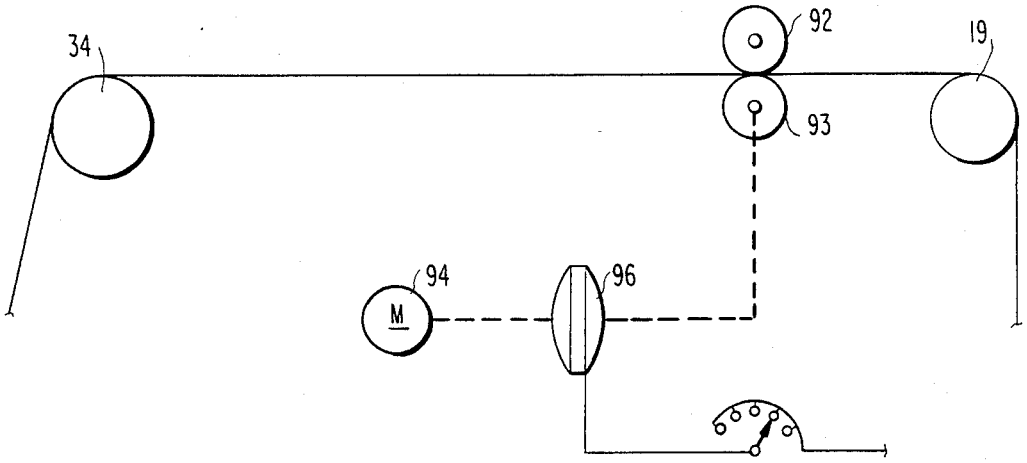
FIG. 11 is a schematic view showing apparatus for use in combination with other apparatus of FIG. 1 for shaping wire and controlling tension in the shaped wire in accordance with the invention.

An important contribution of the invention involves use of the in-line wire shaping means to control wire winding tension. This feature can be provided by a variable drive means, such as a hydraulic or pneumatic motor or by variable torque reaction means between a drive motor and the shaping means. One embodiment for carrying out this preferred method for controlling wire winding tension and shape of the wire simultaneously is shown in FIG. 11. In place of a direct drive or non-slip clutch drive, flattening rolls 92, 93 are driven by motor 94 through a variable torque reaction means 96, such as an electromagnetic particle clutch which is provided with electrical control which adjusts for varying torque requirements. Electromagnetic particle clutches have been used in other arts and their method of operation is known from such applications. By making a variable torque clutch means part of the present combination, selection and control of wire tension and of shaping force are controllable simultaneously at the shaping means.

Winding wire about a non-circular mandrel causes the wire demand rate to change instantaneously. Use of variable torque clutch means as indicated in FIG. 11 provides for a sinusoidal demand imposed on the shaped wire in being formed on a non-circular helical winding mandrel such as 70. The wire demand, and therefore wire movement, changes instantaneously from near zero to a maximum and then back to near zero again with each 90° of revolution of mandrel 70. Use of an electromagnetic particle clutch as the variable torque means 96 provides for this instantaneous variation in demand while maintaining the desired tension, as well as ease of adjustment of the tension, on the shaped wire as fed onto the winding mandrel. The reservoir roll 26 and tension box 30 of FIG. 1 are supplanted by the apparatus of FIG. 11. In the embodiment of FIG. 11, the wire tension imposed by mandrel 70 is controlled at the shaping means through the variable torque clutch means 96.

Tension control can be used to compensate for changes in mechanical characteristics of the wire which, for example, cause the cross-sectional height of loops in a spiral to increase beyond accepted tolerances. An increase in winding tension can be used to control cross-sectional height in such circumstances. Also, the in-line shaping capabilities can be used. Increasing the shaping force used to flatten two diametrically opposed surfaces when cross-sectional height tends to increase due to changes in wire characteristics or wire diameter will keep cross-sectional height within accepted tolerances. The important aspect is that the type of changes normally to be expected in the round wire can be compensated for on the line through wire handling features of the invention without requiring changes in established parameters for the machine and, thus, without significant effect on production rate.

Figure 12:
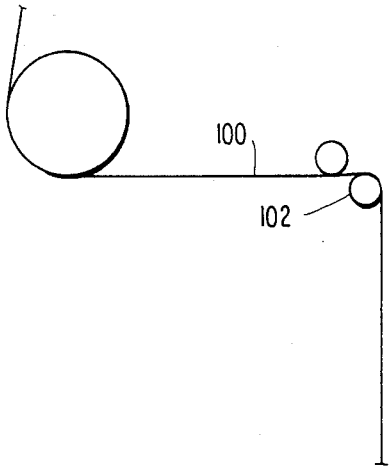
FIG. 12 is a schematic view of means for introducing a longitudinal camber into the wire for winding.
Figure 13:
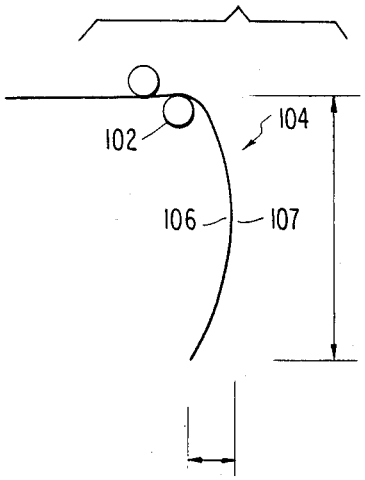
FIG. 13 shows the configuration of a portion of preoriented wire if the wire is cut, releasing longitudinal tension, after passage of the casting roll of FIG. 12.

In order to reverse the direction of curvature of the longitudinal camber introduced, the direction of travel about the casting roll is reversed. As shown in FIG. 12, wire 100 is directed about casting roll 102 to introduce the longitudinal camber shown at 104 in FIG. 13 with concave side 106 and convex side 107. The longitudinal camber shown at 104 is exhibited in the wire after the longitudinal tension on wire 100 is released, e.g. as shown in FIG. 13, by cutting the wire just prior to winding. This same preset longitudinal camber is exhibited in the wire when the longitudinal tension in the wire is released during formation of the spiral loops on a mandrel. Longitudinal camber can be established under the controlled tension conditions available through tension box 30 with the wire shaping force being supplied entirely by driving the shaping means as in the embodiment of FIG. 1. When using the embodiment of FIG. 11, the major portion of the wire shaping force should be applied through the driven shaping means in order to have the effects of passage around the casting roll manifested as longitudinal camber upon release of winding tension.

Data from representative runs of the invention are set forth below:

| | Run A | Run B |
|---|---|---|
| Round Wire Gage | 8 | 13 |
| Diameter | .162" | .092" |
| Shaped Wire Cross-Sectional Dimensions: | | |
| Flattened | .128" | .055" |
| Expanded | .173" | .145" |
| Longitudinal Camber Roll 66 | | |
| Range of Suitable Diameters | ¾" to 3" | ½" to 2" |
| Center-to-Center Dimension | .923" | .324" |
| Pitch | 1.450" | .375" |

The degree of centerline axial turning is selected based on wire characteristics to eliminate surface canting without detriment to established helical winding values established on the machine. When shaping wire by flattening diametrically opposed surfaces, the cross-sectional dimension between such flattened surfaces is preferably reduced between about 10% and about 40%.

In the light of the above teachings, other modifications of materials and means can be resorted to by those skilled in the art; therefore, in determining the scope of the invention, reference should be had to the appended claims.

We claim:

1. In-line process for shaping round wire and fabricating an elongated helically-wound spiral of desired cross-sectional configuration, comprising supplying round wire of selected gage from a continuous-length source of round wire, providing wire shaping means including wire shaping drive means, providing helical winding apparatus for wire including an elongated mandrel having a winding surface of non-circular cross section and being rotatable about its longitudinal axis, helical winding guide tooling associated with such mandrel for establishing a helical angle relationship with the mandrel longitudinal axis of rotation during winding of wire on such mandrel, and means for rotatably driving such mandrel, positioning such mandrel and guide tooling for helical winding of wire including presetting interrelationship of their longitudinal axes to determine lead-in angle for wire to be wound on such mandrel and location of initial contact of such wire longitudinally of such mandrel, such wire shaping means being positioned between such source of round wire and such helical winding apparatus, directing movement of continuous-length wire from such round wire source to such wire shaping means, controllably driving such wire shaping means, changing the cross-sectional configuration of such round wire in such driven wire shaping means to flatten a portion of the peripheral surface of the round wire extending linearly along the periphery of such round wire, directing movement of such shaped wire toward the helical winding apparatus while controlling tension in such shaped wire, preorienting such shaped wire during its movement in approaching the helical winding apparatus by turning such shaped wire about its centerline longitudinal axis to establish a predetermined axial set in the shaped wire to establish a preselected positional relationship of such flattened surface of the wire with the mandrel longitudinal axis, such axial preorienting step being carried out without disturbing the wire lead-in angle for helical winding or contact point of the shaped wire with such mandrel, directing such axially preoriented shaped wire toward such winding apparatus, and helically winding such axially preoriented shaped wire with individual revolutions of such wire being wound in helical angled relationship to the axis of rotation of the mandrel such that the wire is turned about its longitudinal axis by such helical winding an amount substantially equal and opposite to the predetermined axial set established by the axially preorienting step to generate an elongated helically wound spiral comprising a plurality of individual spiral loops, such spiral being generated in a direction parallel to the longitudinal axia of the winding mandrel with the axially preorienting step maintaining such flattened portion of the shaped wire in individual spiral loops in predetermined relationship with the mandrel longitudinal axis uniformly along such elongated finished spiral.

2. The process of claim 1 in which the round wire is withdrawn from such round wire source by driving such wire shaping means.

3. The process of claim 1 in which such wire shaping step includes flattening at least two diametrically opposed surfaces of such round wire during passage between such driven wire shaping means to form planar surfaces extending longitudinally of such wire, such linearly extended flattened surfaces extending substantially uniformly longitudinally of the shaped wire free of re-entrant surfaces, and such axial preorienting step establishes the axial positional relationship of such diametrically opposed planar surfaces for helical winding about such mandrel.

4. The process of claim 3 in which the cross-sectional dimension of the round wire is reduced between about 10% and about 40% between such flattened diametrically opposed surfaces.

5. The process of claim 1 further including the step of controlling longitudinal winding tension in such wire.

6. The process of claim 5 in which the step of preorienting such shaped wire further includes establishing a longitudinal camber of selected curvature in such wire which is exhibited as tension is released in such wire during winding, such longitudinal camber set being established by a predeterminedly controlled angular change in longitudinal direction of movement of such shaped wire, such angular change in direction of movement being carried out prior to centerline axial orienting of such shaped wire.

7. The process of claim 6 in which such angular change in longitudinal direction of movement of the shaped wire is carried out by directing such shaped wire through an angular change in longitudinal direction of movement sufficient to stress convex surface fibers of the wire beyond their elastic limit.

8. The process of claim 1 in which such wire shaping means are controllably driven to simultaneously provide shaping force for the wire and control longitudinal winding tension in the wire.

9. The process of claim 8 in which a limited minor portion of the work force required for shaping of the round wire is provided by the means for rotatably driving such mandrel pulling such round wire through such wire shaping means.

10. Apparatus for shaping round wire and fabricating such shaped wire into an elongated helically-wound spiral for use in the manufacture of metal wire belting, comprising in combination in a continuous line means for delivering round wire into such continuous line from a source for supplying continuous-length round wire of preselected gage, shaping means for shaping at least a portion of the external periphery of such round wire to deliver a shaped wire in such continuous line having a planar peripheral portion extending longitudinally of such wire, drive means for such shaping means capable of providing at least a major portion of the work force required for shaping such round wire, helical winding means for wire in such continuous line including an elongated mandrel having an external winding surface of preselected non-circular cross-sectional configuration, the elongated mandrel having a longitudinal axis, a spiral discharge longitudinal end, a work input longitudinal end, and means for connecting such work input end to a drive means for rotatably driving such elongated mandrel about its longitudinal axis, such mandrel having a portion near its work input end for receiving wire for helical winding, and wire guide tool means associated with such mandrel for directing wire along a helical path in angled relationship to the longitudinal axis of such mandrel to generate a spiral in the direction of the discharge end of such mandrel, means for fixing the longitudinal relationship of such mandrel and guide tooling to establish lead-in angle for helical winding and determine longitudinal location along such mandrel for initiating helical winding, wire handling means located between such wire shaping means and helical winding means for directing longitudinal movement of the shaped wire toward the helical winding means, such wire handling means including means for preorienting the shaped wire during its approach to such helical winding means, such shaped wire preorienting means including axial orienting means for turning such shaped wire about its centerline longitudinal axis, and means for adjusting such axial orienting means without disturbing the lead-in angle and the longitudinal location along such mandrel for initiating helical winding.

11. The combination of claim 10 further including means for controlling longitudinal tension in such shaped wire during winding.

12. The combination of claim 11 in which such means for controlling longitudinal tension in such shaped wire during winding forms part of the drive means for such wire shaping means.

13. The combination of claim 12 in which such means for controlling longitudinal tension in such shaped wire comprises variable torque clutch means connected between such drive means for shaping wire and such wire shaping means.

14. The combination of claim 12 in which the shaped wire preorienting means further includes means for presetting a longitudinal camber in the shaped wire.

15. The combination of claim 10 in which such rotatably driven shaping means comprises flattening roll means for flattening at least two diametrically opposed surfaces of such round wire.

16. The combination of claim 15 in which the drive means for such flattening roll means includes means providing for variation in demand rate during winding of the shaped wire to permit control of longitudinal tension established in the wire for helical winding during shaping of the wire.

17. The combination of claim 15 in which such longitudinal orienting means provides for abruptly changing the longitudinal direction of movement of such shaped wire in approaching such axial orienting means.

18. The combination of claim 10 in which the means for axially orienting such shaped wire comprises means defining an aperture having a cross-sectional configuration for grasping such shaped wire and turning it about its longitudinal centerline axis without changing the longitudinal direction of movement of such shaped wire.

19. The combination of claim 18 in which such aperture is defined by axial orientation roll means.

20. The combination of claim 19 including means located at the exit side of the means defining such aperture for contacting the axially preoriented shaped wire and establishing the direction of longitudinal movement of the axially oriented wire toward such helical winding apparatus.

21. The combination of claim 20 in which such means located at the exit side of such means defining the axially orienting aperture is mounted to move about the longitudinal centerline axis of the shaped wire with such axially orienting aperture during turning of such shaped wire about its longitudinal centerline axis.

* * * * *